US006701111B2

(12) United States Patent
Park et al.

(10) Patent No.: US 6,701,111 B2
(45) Date of Patent: Mar. 2, 2004

(54) LIQUID IMAGE DEVELOPING SYSTEM

(75) Inventors: Woo-young Park, Gyeonggi-do (KR); Kwang-ho No, Gyeonggi-do (KR); Jong-woo Kim, Gyeonggi-do (KR)

(73) Assignee: Samsung Electronics Co., LTD, Suwon (KR)

( * ) Notice: Subject to any disclaimer, the term of this patent is extended or adjusted under 35 U.S.C. 154(b) by 0 days.

(21) Appl. No.: 10/245,388

(22) Filed: Sep. 18, 2002

(65) Prior Publication Data

US 2003/0133725 A1 Jul. 17, 2003

(30) Foreign Application Priority Data

Jan. 12, 2002 (KR) ..... 2002-1886

(51) Int. Cl.[7] ..... G03G 15/10
(52) U.S. Cl. ..... 399/239; 399/240
(58) Field of Search ..... 399/237, 239, 399/249, 348, 240

(56) References Cited

U.S. PATENT DOCUMENTS 5,255,058 A 10/1993 Pinhas et al.
5,666,615 A * 9/1997 Nguyen ..... 399/249
5,937,248 A * 8/1999 Liu et al. ..... 399/237
5,987,283 A * 11/1999 Zhao et al. ..... 399/237
6,122,471 A * 9/2000 Liu et al. ..... 399/237
6,181,901 B1 * 1/2001 Zhao et al. ..... 399/237
6,317,578 B1 * 11/2001 Kusayanagi ..... 399/348

* cited by examiner

*Primary Examiner*—Susan S. Y. Lee
(74) *Attorney, Agent, or Firm*—Staas & Halsey LLP

(57) ABSTRACT

A liquid image developing system including a development container in which a developer having a charge is stored, a photosensitive body, and a development roller which is partially soaked in the developer in the development container and to rotate and form development nip. The system further includes a depositing portion to apply an electric potential to attach the developer to the surface of the development roller, a metering portion to regulate the developer attached to the surface of the development roller at a predetermined thickness at a front end of the development nip, and a cleaning portion to clean the surface of the development roller at a rear end of the development nip. The cleaning portion includes an electrical cleaning member which contacts the development roller and removes the developer attached to the surface of the development roller by an electrical attractive force, and a mechanical cleaning member which contacts the development roller and mechanically cleans the developer attached to the surface of the development roller.

21 Claims, 2 Drawing Sheets

LIQUID IMAGE DEVELOPING SYSTEM

CROSS-REFERENCE TO RELATED APPLICATIONS

This application claims the benefit of Korean Application No. 2002-1886, filed Jan. 12, 2002, in the Korean Industrial Property Office, the disclosure of which is incorporated herein by reference.

BACKGROUND OF THE INVENTION

1. Field of the Invention

The present invention relates to a liquid image developing system, and more particularly, to a liquid image developing system having a simplified structure using a high-concentration developer.

2. Description of the Related Art

In general, liquid image developing systems form an electrostatic latent image corresponding to a desired image by scanning light on a photosensitive body, developing the electrostatic latent image using a developer in which powder-shaped toner is mixed with a liquid solvent, and printing the developed electrostatic latent image on a paper.

FIG. 1 is an example of a conventional image developing system, disclosed in U.S. Pat. No. 5,255,058. As shown in FIG. 1, the conventional image developing system includes a photoconductive drum 10 charged at a predetermined voltage by a photoconductor charging apparatus 14, and an imaging apparatus 16 (i.e., a laser scanning apparatus) to form an electrostatic latent image of a desired image by scanning light onto the charged photoconductive drum 10 and creating a relative voltage difference. The image developing system also includes a developer supplying unit to develop the electrostatic latent image by supplying a developer to the photoconductive drum 10, and an intermediate transfer member 30 to transfer the developed image onto the photoconductive drum 10 and print the transferred image onto a paper 72.

The developer supplying unit prepares the developer with a toner concentration of less than 3% solid and supplies the developer between the photoconductive drum 10 and a development roller 38. For this purpose, the developer supplying unit includes concentration cartridges 82 and 84 containing a concentrated developer with a toner concentration of 25% solid, a solvent cartridge 86 containing pure solvent, and toner reservoirs 55, 57, 59, and 61 to mix the concentrated developer from the concentration cartridges 82 and 84 with the solvent from the solvent cartridge 86 and preparing a developer with a uniform concentration of about 2–3% solid. The developer supplying unit further includes a multicolor liquid developer spray assembly 20 to pump the developing solvent prepared in the toner reservoirs 55, 57, 59, and 61 to pumps 90, 92, 94, and 96, respectively, and to supply the developer to the development roller 38, and a collecting unit to collect excess developer left after the electrostatic latent image is developed. In addition, the collecting unit includes a collection container 50 to collect the developer supplied between the development roller 38 and the photoconductive drum 10 and to return the developer to the toner reservoirs 55, 57, 59, and 61 for each color, and a squeeze roller 26 to impress the photoconductive drum 10 on which the image is developed, and to squeeze the solvent contained in the developed image. The collecting unit further includes a separator 66 to collect the squeezed developer through the collection container 50, to separate color toner from the collection container 50 and to return the solvent to a solvent reservoir 65.

In the above structure, in order to perform a development operation, a developer having four colors, such as yellow (Y), magenta (M), cyan (C), and black (K), with a toner concentration of about 2–3% solid, is provided in the toner reservoirs 55, 57, 59, and 61. Of course, in the case of a system developing a single color, such as black, only one developer is required. In order to prepare a developer for each color, the developer supplying unit fabricates a developer with a corresponding concentration by supplying the concentrated developer and the pure solvent from the concentration cartridges 82 and 84 and the solvent cartridge 86 to the toner reservoirs 55, 57, 59, and 61, respectively. For this purpose, each of the toner reservoirs 55, 57, 59, and 61 measures the concentration of the developer that is mixed according to a concentration sensor (not shown). Likewise, when the developer is prepared, the development operation begins. First, the photoconductor charging apparatus 14 charges the photoconductive drum 10 to a predetermined potential. In this state, the imaging apparatus 16 scans light on the charged photoconductive drum 10 to form an electrostatic latent image of a desired image. Subsequently, the pumps 90, 92, 94, and 96 operate such that the developer provided in the toner reservoirs 55, 57, 59, and 61 is supplied between the development roller 38 and the photoconductive drum 10 through the multicolor liquid developer spray assembly 20, thereby forming the electrostatic latent image. The developed image is transferred to the intermediate transfer member 30 and is printed directly onto the paper 72 if the developed image is formed of only one color. However, if a color image is implemented by overlapping a developer having a plurality of colors, the charge, exposure, and development operations are repeated for each of the colors. For example, if there are four colors, such as yellow (Y), magenta (M), cyan (C), and black (K), the developed image for each color is overlapped on the intermediate transfer member 30. The overlapped color image is printed onto the paper 72 passing through a space between the intermediate transfer member 30 and an impression roller 71.

However, the structure of the system in the operations from preparing the developer to supply and collect the developer is considerably complicated. For this reason, a concentrated high-concentration developer cannot be directly used in the development operation, and instead a low-concentration developer (less than 3% solid) is used in the development operation. If the developer with a low concentration is used, mobility is improved, and thus a difference in density of toner throughout the image is reduced. However, as described above, the concentrated developer and solvent in each of the cartridges 82, 84, and 86, are sent to the toner reservoirs 55, 57, 59, and 61, and mixed with a developer with the low concentration, and thus an electrostatic latent image is developed having the developer with a low concentration. Then, the solvent contained in the developed image is squeezed and collected so that the developer has a high concentration suitable for printing. To make things worse, the size and cost of embedded devices further amplify the problems of this complicated structure.

Thus, in order to solve these problems, a new image developing system is required.

SUMMARY OF THE INVENTION

Accordingly, it is an object of the present invention to provide a liquid image developing system having an improved structure in which a high-concentration developer is smoothly used in a development operation without requiring squeezing.

Additional objects and advantages of the invention will be set forth in part in the description which follows and, in part, will be obvious from the description, or may be learned by practice of the invention.

The foregoing and other objects of the present invention are achieved by providing a liquid image developing system, including a development container to store a developer having a charge; a photosensitive body; a development roller partially soaked in the developer in the development container and to rotate to form a development nip with the photosensitive body; a depositing portion to attach the developer to a surface of the development roller; a metering portion to regulate the developer attached to the development roller at a uniform thickness at a first end of the development nip; and a cleaning portion to clean the surface of the development roller at a second end of the development nip; wherein the cleaning portion includes an electrical cleaning member which contacts the development roller and removes the developer attached to the surface of the development roller by an electrical attractive force, and a mechanical cleaning member which contacts the development roller and mechanically cleans the developer attached to the surface of the development roller.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
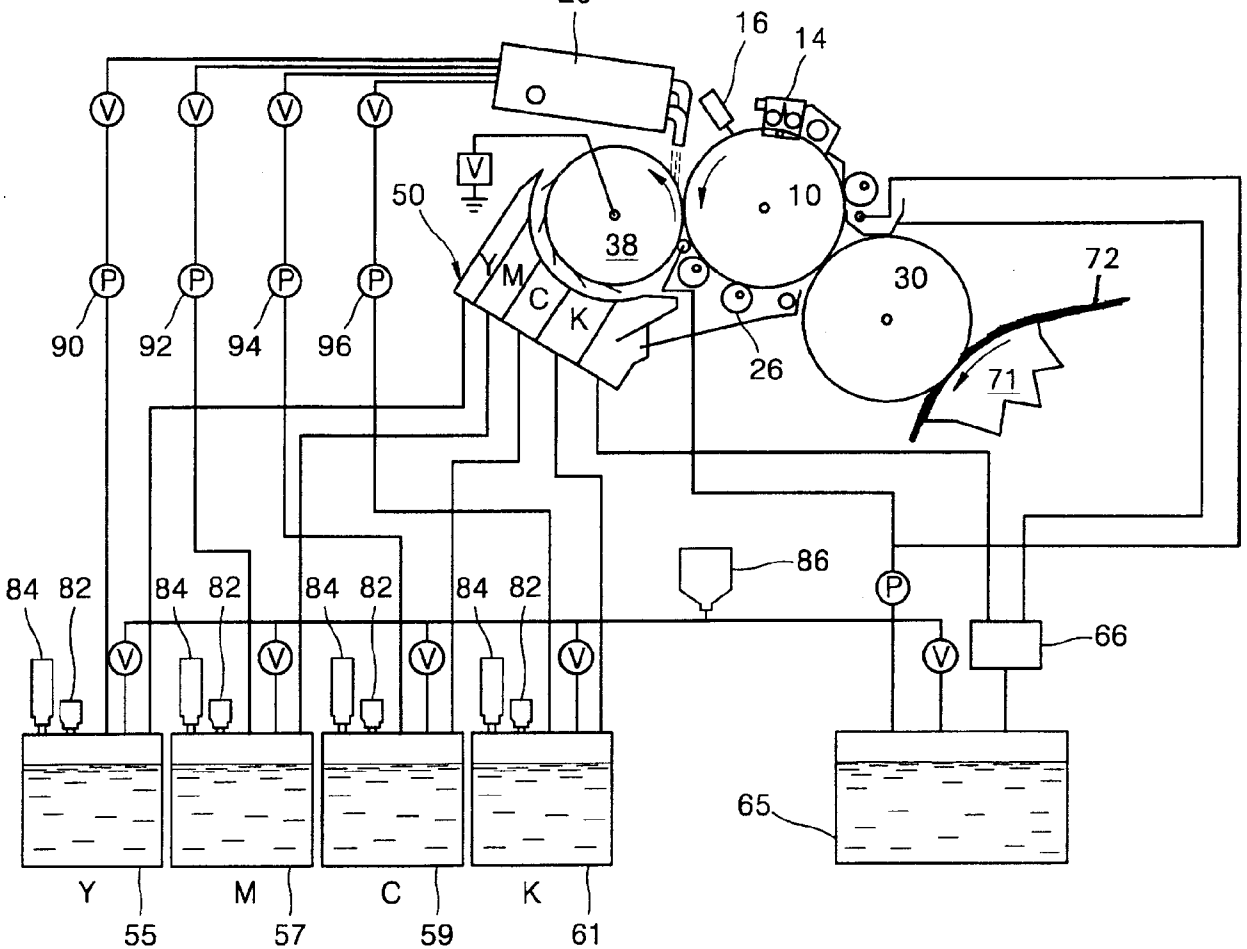
FIG. 1 (PRIOR ART)
FIG. 1 illustrates a conventional image developing system.

Reference will now be made in detail to the present preferred embodiments of the present invention, examples of which are illustrated in the accompanying drawings, wherein like reference numerals refer to like elements throughout.

Figure 2:
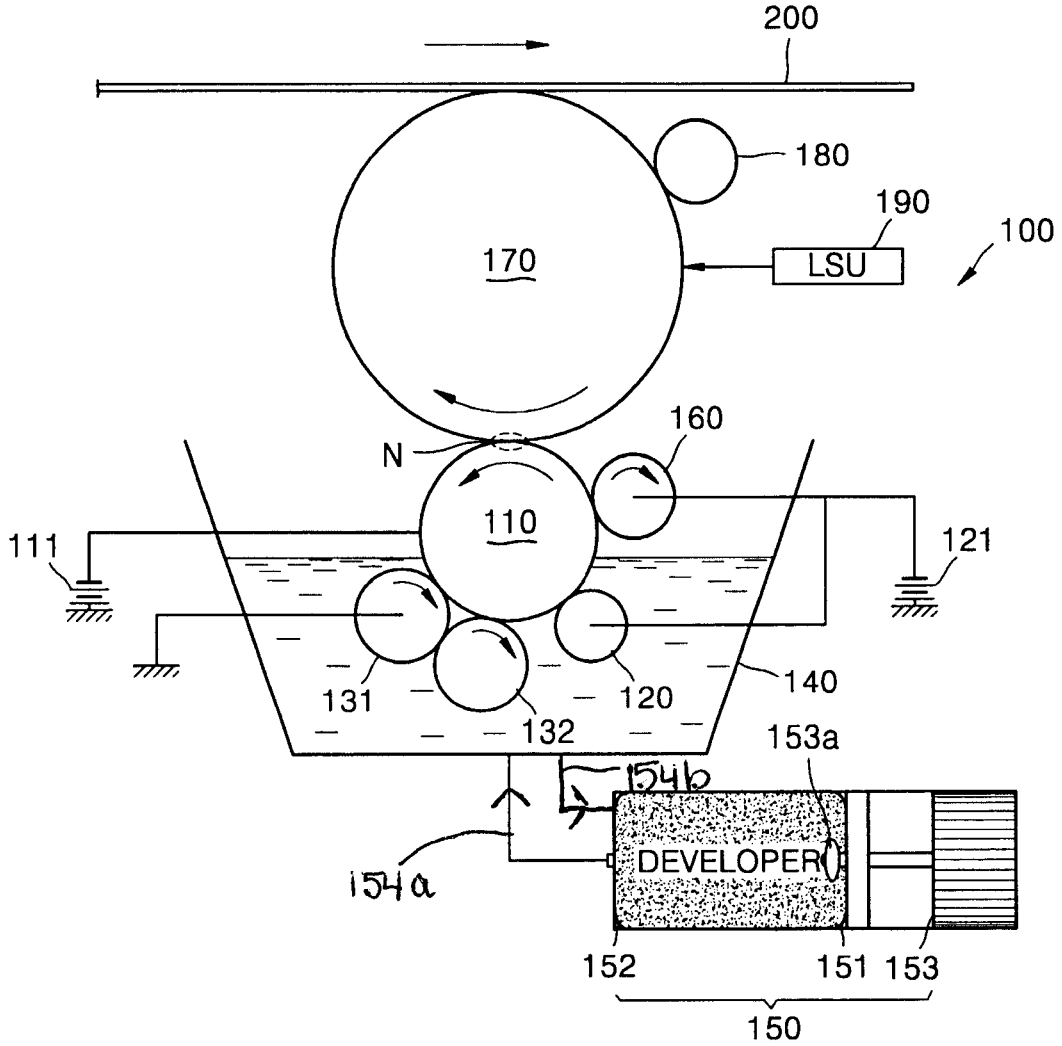
FIG. 2 illustrates a liquid image developing system according to an embodiment of the present invention.

FIG. 2 illustrates a liquid image developing system 100 according to an embodiment of the present invention. As shown in FIG. 2, the liquid image developing system 100 includes a cartridge 150 in which a developer is stored, and a development container 140 to which the developer is supplied from the cartridge 150. High concentration developer having a concentration of about 3–40% solid is used as the developer supplied to the development container 140 from the cartridge 150. The cartridge 150 includes a case 151, a tube 152 built in the case 151 in which the developer is contained, and a piston 153 with one side 153*a* attached to the tube 152, to perform a reciprocating movement in the case 151 and selectively compress and expand the tube 152. Thus, if the piston 153 compresses the tube 152, the developer in the tube 152 is supplied to the development container 140 through a supply line 154*a*. In the opposite case, if the piston 153 expands the tube 152, the developer contained in the development container 140 is absorbed into the tube 152 through a collection line 154*b*.

Within the development container 140 there is a development roller 110 which is partially soaked in the developer and rotates with a photosensitive body 170 to form a development nip N, a metering roller 160 to regulate the developer stained on the circumference of the development roller 110 to a predetermined thickness at a front end of the development nip N, a depositing portion to apply an electric potential to attach the developer to the surface of the development roller 110, and a cleaning portion to clean the surface of the development roller 110 at a rear end of the development nip N.

The depositing portion includes a depositing roller 120 contacting the development roller 110, and a depositing power supply part 121 to apply a voltage to the depositing roller 120. The depositing roller 120 is formed of a stainless material and attaches the developer to the development roller 110 by an electric force due to a voltage applied from the depositing power supply part 121, while being soaked in the developer. The depositing roller 120 may contact the development roller 110, or may be spaced at a distance of about 50–200 $\mu$m (for example, 50–100 $\mu$m) away from the development roller 110. The depositing roller 120 may be a fixed roller or a rotating roller or may have a plate shape having a curvature similar to the circumference of the development roller 110.

The cleaning portion includes a plurality of cleaning rollers 131 and 132 to rotate in contact with the development roller 110 in an opposite direction to the development roller 110. The cleaning roller 131, which first faces the development roller 110 after the development roller 110 passes through the development nip N, is an electrical cleaning roller. The cleaning roller 131 contacts the development roller 110 while being grounded, and applies an electrical attractive force to the developer. That is, in the present embodiment, toner particles contained in the developer are negatively charged, and thus a negative voltage is applied to the development roller 110 by a development power supply part 111. Thus, if the grounded electrical cleaning roller 131 contacts the development roller 110, an electrical attractive force is applied to the developer, and thus the developer moves to the electrical cleaning roller 131. When the toner particles contained in the developer are positively charged, a positive voltage is applied to the development roller 110, and the electrical cleaning roller 131 is grounded, and the electrical cleaning roller 131 creates a relatively low electrical potential, and thus an electrical attractive force is also applied to the developer. Also, the electrical cleaning roller 131 removes an electrical latent image formed on the development roller 110. That is, the developer attaches to the photosensitive body 170 from the development roller 110 through the development nip N in an image portion formed on the photosensitive body 170 by an LSU (laser scanning unit) 190, whereas the developer does not move to the photosensitive body 170 in a non-image portion. Thus, after the developer passes through the development nip N, an electrical latent image is formed on the surface of the development roller 110 by a difference in the amount of charge between a portion in which the developer remains and a portion in which there is no developer due to the movement to the photosensitive body 170. This may disturb accurate development in the next development operation, that is, this means that the electrical latent image is planarized to a ground electrical potential by the grounded electrical cleaning roller 131. The development roller 110 and the electrical cleaning roller 131 may be formed of polyurethane rubber or NBR as a conductive elastomer, having a resistance of about $10^5$ to about $10^8$ ohm, a hardness of shore A 25–65 degrees, and a surface roughness of Ra 1–4 μm. The cleaning roller 132 is mechanical and contacts the development roller 110 to mechanically clean the developer stained on the surface of the development roller 110. The cleaning roller 132 is mounted at a rear end of the electrical cleaning roller 131. The mechanical cleaning roller 132, having a porous surface, rotates to contact the development roller 110 and cleans toner particles of the developer that is not developed.

Finally, the cleaning portion improves the cleaning efficiency by simultaneously performing electrical cleaning and mechanical cleaning. For example, when only mechanical cleaning is performed, cleaning of the development roller 110 may not be completely performed. In such a case, the amount of remaining toner is gradually accumulated, and thus the development roller 110 may deteriorate. Also, due to the remaining electrical latent image, a subsequent development operation may be disturbed. Accordingly, electrical cleaning is performed before mechanical cleaning, thereby improving the cleaning efficiency.

In FIG. 2, reference numeral 200 denotes a transfer belt to transfer the image developed on the photosensitive drum and print the transferred image onto the paper, and reference numeral 180 denotes a charging roller to charge the photosensitive body 170.

Only one developing system is provided in the image forming device 100 using a single color, but the above-mentioned developing system can be used in a color image forming device to overlap and print a plurality of colors.

In the structure of FIG. 2, in order to perform a development operation, the corresponding cartridge 150 supplies the developer for each color to the development container 140 to charge the developer to a predetermined level. As described above, the charged developer is a high-concentration developer with a concentration of about 3–40% solid (for example, 3–12% solid). After the developer reaches this concentration, the development operation begins. First, bias voltages of about −300 to about −550 V and about −500 to about −1550 V are applied to the development roller 110 and to the depositing roller 120, respectively. The bias voltage applied to the development roller 110 lies between a voltage of about −900 V applied to the photosensitive body 170 by the charging roller 180 and a voltage of about −100 V applied to a portion in which an electrostatic latent image is formed by the laser scanning unit 190. If the bias voltage is applied to the development roller 110 in this way, toner particles of the developer are negatively charged, and thus attach to the surface of the development roller 110 by a voltage difference between the development roller 110 and the depositing roller 120. In this case, toner particles may electrically strongly or weakly attach to the development roller 110. In this experiment, developer with a concentration of 3–12% solid is used, and the concentration of the developer attached to the development roller 110 by an electric force before passing the metering roller 160 is 6–14% solid, with a mass/area (M/A) of 400–1100 $\mu g/cm^2$. When using a developer with a concentration of 3% solid, which is a relatively low concentration, the concentration of the development roller 110 is 6% solid, which is twice as much as the initial concentration. When a developer with a concentration of 12% solid is used, the concentration of the development roller 110 slightly increased to 12–14% solid. However, before passing the metering blade 160, a concentration difference of the developer is large, and thus it is difficult to develop an image with a uniform concentration if the electrostatic latent image formed on the photosensitive body 170 is developed without change.

Figure 3:
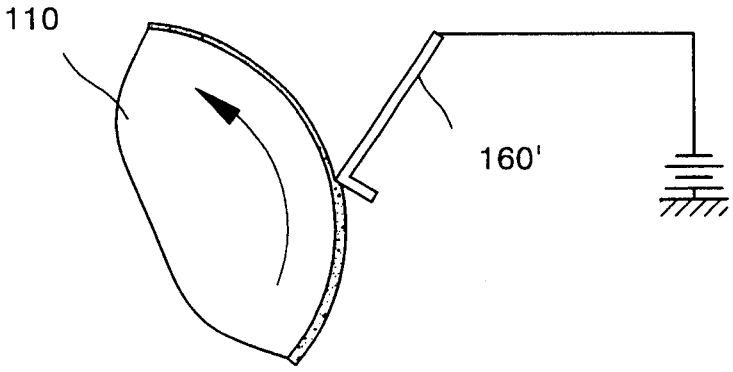
FIG. 3 is an illustration of the metering portion shown in FIG. 2.

Afterwards, the developer stained on the development roller 110 is regulated by the metering roller 160 to a predetermined and uniform thickness. In this case, the same voltage as that of the depositing roller 120 is applied to the metering roller 160 such that the developer stained on the surface of the development roller 110 does not attach to the metering roller 160 by an electrical force. Meanwhile, in the present embodiment, the thickness of the developer on the surface of the development roller 110 is regulated using a member such as a roller. However, as shown in FIG. 3, a metal plate 160' having a thickness of 0.05–2 microns is formed in an L-shape so that the thickness of the developer on the surface of the development roller 110 is regulated. Of course, due to variations of the metering roller 160, the concentration and the M/A of the developer stained on the surface of the development roller 110 before the development operation gradually varies. However, when the developer with a concentration of 3–40% solid is used, and these conditions are slightly changed, the concentration and the M/A on the development roller 110 before the development operation is about 18–35% solid and about 150–500 $\mu g/cm^2$, respectively, thereby a relative uniform concentration is achieved. In particular, when the developer with a concentration of about 3–12% solid is used, the concentration and the M/A of the developer stained on the development roller 110 after passing through the depositing roller 120 is about 7–14% solid and about 413–1126 $\mu g/cm^2$, respectively. Furthermore, the concentration and the M/A of the developer stained on the development roller 110 before the development operation after passing through the metering blade 160 is about 19.6–31% solid and about 220–270 $\mu g/cm^2$, respectively. Thus, this is a substantially uniform distribution. In this case, the distance between the depositing roller 120 and the development roller 110 is about 70–100 μm, and the voltage difference between the development roller 110 and the depositing roller 120 is 500 V. When using the system according to the present embodiment, the concentration of the developer before the development operation can be maintained uniform and the developer can be used in the development operation even though a developer within a wide range of a concentration, i.e., 3–12% solid, is used.

Subsequently, the electrical latent image that is formed on the photosensitive body 170 through the development nip N is developed using the development roller 110. In such a case, the concentration of the developer of the image developed on the photosensitive body 170 is high (greater than 25% solid), without the flow of excess solvent. Thus, a transfer operation can be performed without an additional squeezing operation.

The toner particles left on the development roller 110 after the development operation are completely removed by the electrical cleaning roller 131 and the mechanical cleaning roller 132. That is, the electrical cleaning roller 131 removes the developer which does not attach to the photosensitive body 170 and is left on the development roller 110 by an electrical attractive force. Since a relative potential difference created by the grounded electrical cleaning roller 131 is used as the electrical attractive force, additional power consumption does not occur. Afterwards, the mechanical cleaning roller 132 simultaneously cleans the surfaces of the development roller 110 and the electrical cleaning roller 131, thereby completing cleaning.

Meanwhile, the developed image is transferred onto the transfer belt 200, and if the developed image is formed of only one color, the developed image is printed directly onto the paper. However, in the case of implementing a color image, each image developed by each developing system for four colors, such as yellow (Y), cyan (C), magenta (M), and black (K), is overlapped on the transfer belt 200, and then is printed onto the paper.

In the image developing system, the high-concentration developer can be directly used in the development operation without a dilution operation, and thus the structure to supply the developer can be considerably simplified, and the squeezing operation of squeezing excess solvent can be omitted. In addition, the developer stained on the development roller 110 in the development operation can be maintained at a uniform concentration using the metering roller, and using the cleaning portion to simultaneously perform electrical cleaning and mechanical cleaning after the development operation, thereby achieving a very efficient system which is capable of completely cleaning the remaining developer.

As described above, the liquid image developing system according to the present invention has the following advantages.

First, since the high-concentration developer in the cartridge is supplied directly to the development container without an additional dilution operation, the structure to supply the developer can be simplified, and thus the overall size of the printer can be reduced.

Second, using the metering roller or metal plate, the distribution of the concentration of the developer in the development container and the concentration of the developer on the development roller can be uniform, and thus a controller to dilute the developer and adjust the concentration of the developer is not required.

Third, as the concentration of the developer is increased, the spread of the image is reduced, thereby achieving a high quality image capable of preventing the contamination of the non-image portion.

Fourth, by performing the development operation using the high-concentration developer, a squeezing operation can be omitted.

Fifth, due to high concentration contact development, dwell time can be reduced, thereby increasing printing speed.

Sixth, electrical cleaning and mechanical cleaning are simultaneously performed, thereby completely removing the developer stained on the development roller after the development operation and reducing wear on the development roller and improving the reliability of the development operation.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A liquid image developing system, comprising:

a development container to store a developer having a charge;

a photosensitive body;

a development roller partially soaked in the developer in the development container to rotate and form a development nip with the photosensitive body;

a depositing portion to attach the developer to a surface of the development roller;

a metering portion to regulate the developer attached to the development roller at a uniform thickness, at a first end of the development nip; and a cleaning portion to clean the surface of the development roller at a second end of the development nip;

wherein the cleaning portion comprises:

an electrical cleaning member which contacts the development roller and removes the developer attached to the surface of the development roller by an electrical attractive force, and a mechanical cleaning member which contacts the development roller and mechanically cleans the developer attached to the surface of the development roller.

2. The system of claim 1, wherein the developer is negatively charged, a negative voltage is applied to the development roller, and the electrical cleaning member is grounded.

3. The system of claim 1, wherein the electrical cleaning member and the mechanical cleaning member are rollers which rotate and contact the development roller.

4. The system of claim 3, wherein the mechanical cleaning roller simultaneously contacts and thereby cleans the development roller and the electrical cleaning roller.

5. The system of claim 1, wherein the metering portion is close to the surface of the development roller so as to remove the developer at a thickness greater than the uniform thickness, and the metering portion comprises a fixing blade or a rotation roller.

6. The system of claim 1, wherein a concentration of the developer is 3–40% solid.

7. A liquid image developing system, comprising:

a container to store a developer having a charge;

a development roller partially soaked in the developer in the container, having a surface to receive the developer thereon;

a photosensitive body having a surface to receive the developer from the development roller, and a development nip formed between the photosensitive body and the development roller; and a cleaning portion to clean the surface of the development roller, the cleaning portion comprising:

a first cleaner to remove the developer received by the surface of the development roller by an electrical attractive force, and a second cleaner to mechanically remove the developer received by the surface of the development roller.

8. The system of claim 7, further comprising:

a depositing roller to attach the developer to the development roller; and a depositing power supply to apply a voltage to the depositing roller to attach the developer thereto.

9. The system of claim 8, wherein the depositing roller contacts the development roller.

10. The system of claim 8, wherein the depositing roller is 50–100 microns from the development roller.

11. The system of claim 7, wherein the first and second cleaners simultaneously clean the surface of the development roller.

12. The system of claim 7, wherein the first and second cleaners completely remove the developer from the surface of the development roller.

13. The system of claim 7, wherein the development roller and the first cleaner are formed of polyurethane rubber or NBR, having a resistance of $10^5$ to $10^8$ ohm, a hardness of shore A 25–65 degrees, and a surface roughness of 1–4 $\mu$m.

14. The system of claim 7, wherein the first and second cleaners are first and second cleaning rollers in contact with the development roller.

15. The system of claim 14, wherein the first and second cleaning rollers rotate in a direction opposite to a direction of rotation of the development roller.

16. The system of claim 15, wherein the development roller contacts the first cleaning roller at a first end of the first cleaning roller, and the second cleaning roller contacts the first cleaning roller at a second end of the first cleaning roller, the second end being displaced relative to the first end in the direction of rotation of the development roller.

17. The system of claim 7, further comprising a plurality of the containers, each storing the developer to develop a different color, and the system develops a multi-colored image.

18. A method to generate an image, comprising:

soaking a depositing roller in a developer;

partially soaking a development roller in the developer;

generating a voltage difference between the development roller and the depositing roller to attach the developer to the development roller;

applying a first voltage to a metering roller to maintain the developer on the development roller at a uniform thickness; and setting a first cleaning roller to a second voltage different from the first voltage, to thereby remove the developer from the development roller.

19. The method of claim 18, further comprising:

applying a voltage to the development roller equal to the voltage applied to the metering roller.

20. The method of claim 18, further comprising:

providing a second cleaning roller to mechanically remove the developer from the development roller.

21. The method of claim 18, wherein the setting of the first cleaning roller to the second voltage comprises grounding the first cleaning roller.

* * * * *